US008346119B2

(12) United States Patent
Ishikawa et al.

(10) Patent No.: US 8,346,119 B2
(45) Date of Patent: Jan. 1, 2013

(54) CLEANING DEVICE, CHARGING DEVICE, AND IMAGE FORMING APPARATUS

(75) Inventors: Takatoshi Ishikawa, Ebina (JP); Takashi Kawabata, Ebina (JP); Osamu Handa, Ebina (JP); Atsuhito Tokuyama, Ebina (JP); Tsutomu Komiyama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 153 days.

(21) Appl. No.: 12/838,079

(22) Filed: Jul. 16, 2010

(65) Prior Publication Data

US 2011/0142485 A1 Jun. 16, 2011

(30) Foreign Application Priority Data

Dec. 14, 2009 (JP) ..... 2009-282369

(51) Int. Cl.
*G03G 15/16* (2006.01)
*G03G 21/00* (2006.01)

(52) U.S. Cl. ..... 399/101; 399/349; 399/353

(58) Field of Classification Search ..... 399/101, 399/349, 353, 358, 99, 343; 15/256.5, 256.51, 15/256.52

See application file for complete search history.

(56) References Cited

U.S. PATENT DOCUMENTS

| | | | | |
|---|---|---|---|---|
| 5,383,011 | A | 1/1995 | Numagami et al. | |
| 7,953,363 | B2 * | 5/2011 | Honjoh et al. | 399/349 X |
| 2007/0003337 | A1 * | 1/2007 | Shakuto et al. | 399/349 |
| 2011/0064495 | A1 * | 3/2011 | Tanaka | 399/349 |

FOREIGN PATENT DOCUMENTS

| | | | |
|---|---|---|---|
| JP | 11-327191 | A * | 11/1999 |
| JP | 3005114 | B2 | 11/1999 |
| JP | 3196492 | B2 | 6/2001 |
| JP | 2004-317961 | A | 11/2004 |

* cited by examiner

*Primary Examiner* — Sophia S Chen
(74) *Attorney, Agent, or Firm* — Sughrue Mion, PLLC

(57) ABSTRACT

A cleaning device includes: a brush that has numerous bristles rotating and contacting to the surface of an image carrier, a removing member disposed so as to contact to the numerous bristles and removes a developer adhering to the numerous bristles by elastically deforming the numerous bristles and further returning the numerous deformed bristles back to normal, and a transport member disposed lower than the removing member in the gravitational direction and transports the developer removed with the removing member by rotating on an axis, wherein at least a part of the developer removed from the numerous bristles falls to a farther position than the axis of the transport member from the brush in the horizontal direction.

16 Claims, 8 Drawing Sheets

CLEANING DEVICE, CHARGING DEVICE, AND IMAGE FORMING APPARATUS

CROSS-REFERENCE TO RELATED APPLICATIONS

This application is based on and claims priority under 35 USC 119 from Japanese Patent Application No. 2009-282369 filed Dec. 14, 2009.

BACKGROUND

Technical Field

The present invention relates to a cleaning device, a charging device, and an image forming apparatus.

SUMMARY

According to an aspect of the invention, there is provided a cleaning device including: a brush that has numerous bristles rotating and contacting to the surface of an image carrier; a removing member that is disposed so as to contact to the numerous bristles and removes a developer adhering to the numerous bristles by elastically deforming the numerous bristles and further returning the numerous deformed bristles back to normal; and a transport member that is disposed lower than the removing member in the gravitational direction and transports the developer removed with the removing member by rotating on an axis, wherein at least a part of the developer removed from the numerous bristles falls to a farther position than the axis of the transport member from the brush in the horizontal direction.

BRIEF DESCRIPTION OF THE DRAWINGS

An exemplary embodiment of the present invention will be described in detail based on the following figures, wherein.

DETAILED DESCRIPTION

Figure 1:
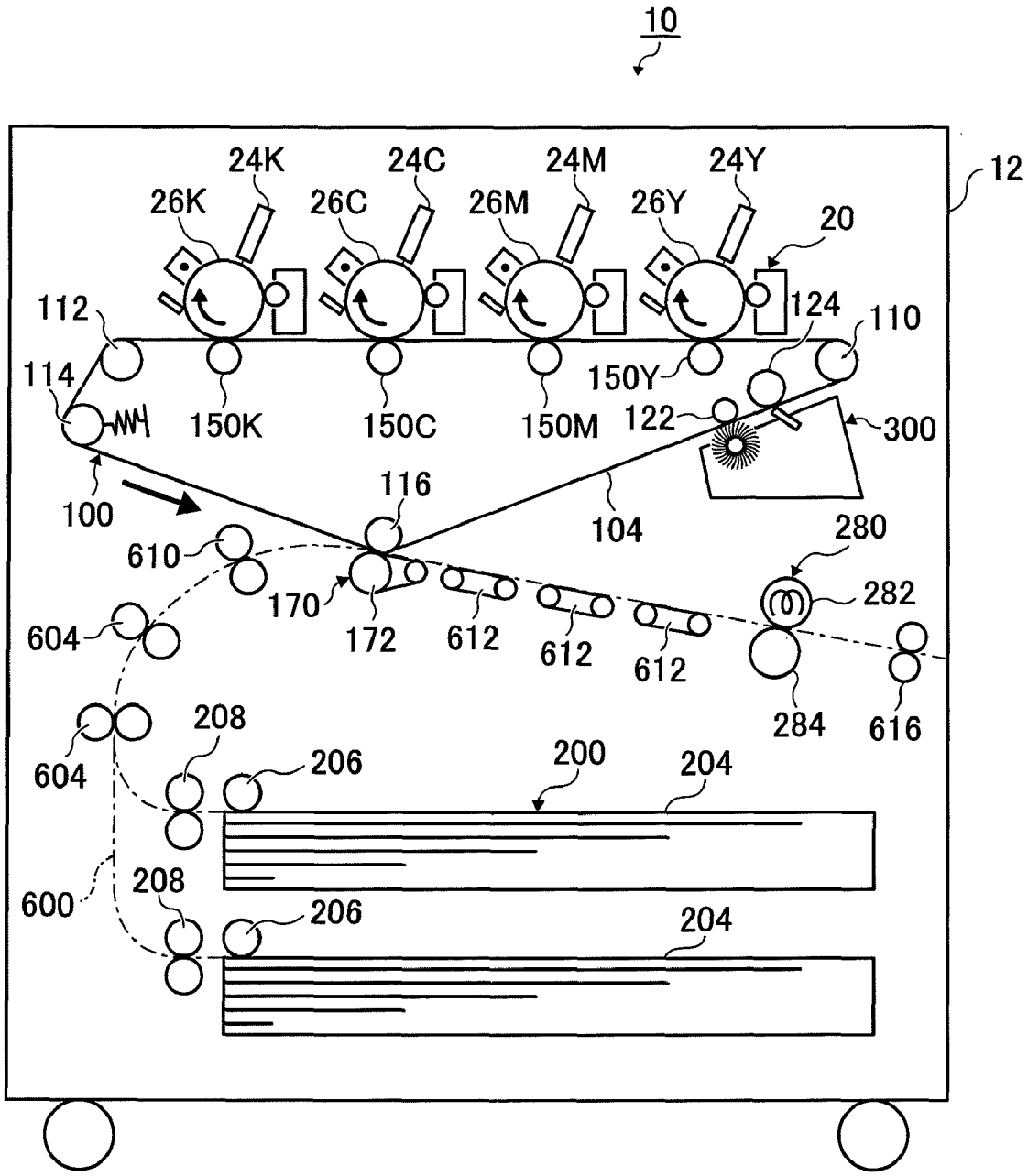
FIG. 1 is a sectional view, as seen from the front, of an image forming apparatus according to the exemplary embodiment of the present invention.

Next, an exemplary embodiment of the present invention will be described with reference to the drawings. FIG. 1 illustrates an image forming apparatus 10 according to the exemplary embodiment of the present invention. As shown in FIG. 1, the image forming apparatus 10 has an image forming apparatus main body 12. In the image forming apparatus main body 12, an image forming section 20, a transfer device 100, a sheet supply device 200, a fixing device 280, and a cleaning device 300 are provided. Further, a transport path 600 is formed in the image forming apparatus main body 12.

The image forming section 20 serves as an image forming section for forming an image with a developer, and has a yellow developer image forming section 24Y, a magenta developer image forming section 24M, a cyan developer image forming section 24C, and a black developer image forming section 24K. The yellow developer image forming section 24Y, the magenta developer image forming section 24M, the cyan developer image forming section 24C, and the black developer image forming section 24K have each photoreceptor drums 26Y, 26M, 26C, and 26K employed as a image carrier, respectively. Accordingly, a yellow developer image is formed with the yellow developer; a magenta developer image is formed with the magenta developer; a cyan developer image is formed with the cyan developer; and a black developer image is formed with the black developer. As an employed developer i.e. a yellow developer, a magenta developer, a cyan developer, and a black developer, a toner is used, and the toner may include a small amount of carrier. Each developer of the colors yellow, magenta, cyan, and black will described in detail later.

The transfer device 100 has an intermediate transfer member 104, first transfer devices 150Y, 150M, 150C, and 150K, and a second transfer device 170. The intermediate transfer member 104 serves as an image carrier holding an image formed with a developer by the image forming section 20. Further, in the exemplary embodiment, the intermediate transfer member 104 has an endless belt-shape, and is supported by plural support rollers 110, 112, 114, and 116 so as to rotate. The intermediate transfer member 104 furthermore has a charge backup roller 122 and a cleaning backup roller 124 inside thereof.

The intermediate transfer member 104 is made of a material generated by dissolving or dispersing a conductive material into a thermoplastic resin such as a polycarbonate resin, a polyvinylidene fluoride resin, a polyalkylene terephthalate resin, a blend material with polycarbonate and polyalkylene terephthalate, an ethylene tetrafluoroethylene copolymer, or a thermoset resin such as polyimide and a copolymer with polyimide and polyamide, and the material has a volume resistance $10^9$ to $10^{14}$ ohm-cm. When the intermediate transfer member 104 is made of a material having the volume resistance more than $10^{11}$ ohm-cm, for instance $10^{11}$ to $10^{14}$ ohm-cm, the intermediate transfer member 104 provides an image having a high-quality, because of e.g. the inhibition of the discharge at the time of transferring, compared with a material with the volume resistance less than $10^{11}$ ohm-cm.

At least one of the plural support rollers 110, 112, 114, and 116 serves as a drive transmission roller for transmitting drive to the intermediate transfer member 104, that is, rotates in response to drive transmitted by a drive source omitted from the illustration via a drive transmitting mechanism such as a gear train omitted from the illustration, and accordingly allows the intermediate transfer member 104 to rotate. In the exemplary embodiment of the present invention, the support roller 110 serves as the drive transmission roller. At least one of the plural support rollers 110, 112, 114, and 116 further serves as a tension roller for tightening the intermediate transfer member 104. In the exemplary embodiment of the present invention, the support roller 114 serves as the tension roller.

The charge backup roller 122 is arranged so as to be opposite to a brush 330 described later (refer to FIG. 3) via the intermediate transfer member 104. The charge backup roller 122 may have a function of supporting the intermediate transfer member 104.

The cleaning backup roller 124 is arranged downstream of the charge backup roller 122 in the rotating direction of the intermediate transfer member 104, and is provided so as to be opposite to a cleaning blade described later (refer to FIG. 3) via the intermediate transfer member 104. The cleaning backup roller 124 may have a function of supporting the intermediate transfer member 104.

The first transfer devices 150Y, 150M, 150C, and 150K respectively have each first transfer rollers 152Y, 152M, 1520, and 152K (refer to FIG. 2) to apply a bias voltage for first transfer, and respectively transfer each image formed on each surface of the photoreceptor drums 26Y, 26M, 26C, and 26K with a developer to the intermediate transfer member 104.

The second transfer device 170 has a second transfer roller 172, and is employed for the second transfer transferring a developer image transferred on the intermediate transfer member 104 to a sheet.

The fixing device 280 has a heat roller 282 heating a sheet, and a pressure roller 284 applying pressure to a sheet.

The sheet supply device 200 has, for instance each two, sheet containers 204 containing a sheet used as a recording medium in a stack, feed rollers 206 feeding the sheet in the sheet containers 204, and separation rollers 208 for preventing double-feed of sheets.

The transport path 600 is a transport path through which a sheet is transported from the sheet supply device 200 to the second transfer device 170 and is further ejected outside the image forming apparatus main body 12 from the second transfer device 170. In order to upstream side of a sheet transport direction, the sheet supply device 200, conveyance rollers 604, a registration roller 610, the second transfer device 170, sheet transfer devices 612, the fixing device 280, and a exit roller 616 are arranged along the transport path 600.

The conveyance rollers 604 transport a sheet toward the registration roller 610, respectively. Retaining temporarily the leading edge of the sheet to stop the transport of the sheet toward the second transfer device 170, the registration roller 610 restarts the transport of the sheet toward the second transfer device 170 at a timing where the developer image formed by the first transfer on the intermediate transfer member 104 reaches the second transfer device 170.

The sheet conveyance devices 612 support the sheet having the unfixed developer image thereon from below, and transport toward the fixing device 280. After the fixing of the developer image by the fixing device 280, the sheet is transported out of the image forming apparatus main body 12.

The cleaning device 300 is arranged in the downstream of the second transfer device 170 and in the upstream side of the first transfer device 150Y that is arranged at the most-upstream position in the first transfer devices 150Y, 150M, 150C, and 150K, in the movement direction, i.e. a rotating direction of the intermediate transfer member 104. The cleaning device 300 serves as a cleaning device for cleaning the intermediate transfer member 104, and further a charging device for charging the intermediate transfer member 104. The cleaning device 300 will be described in detail later.

Figure 2:
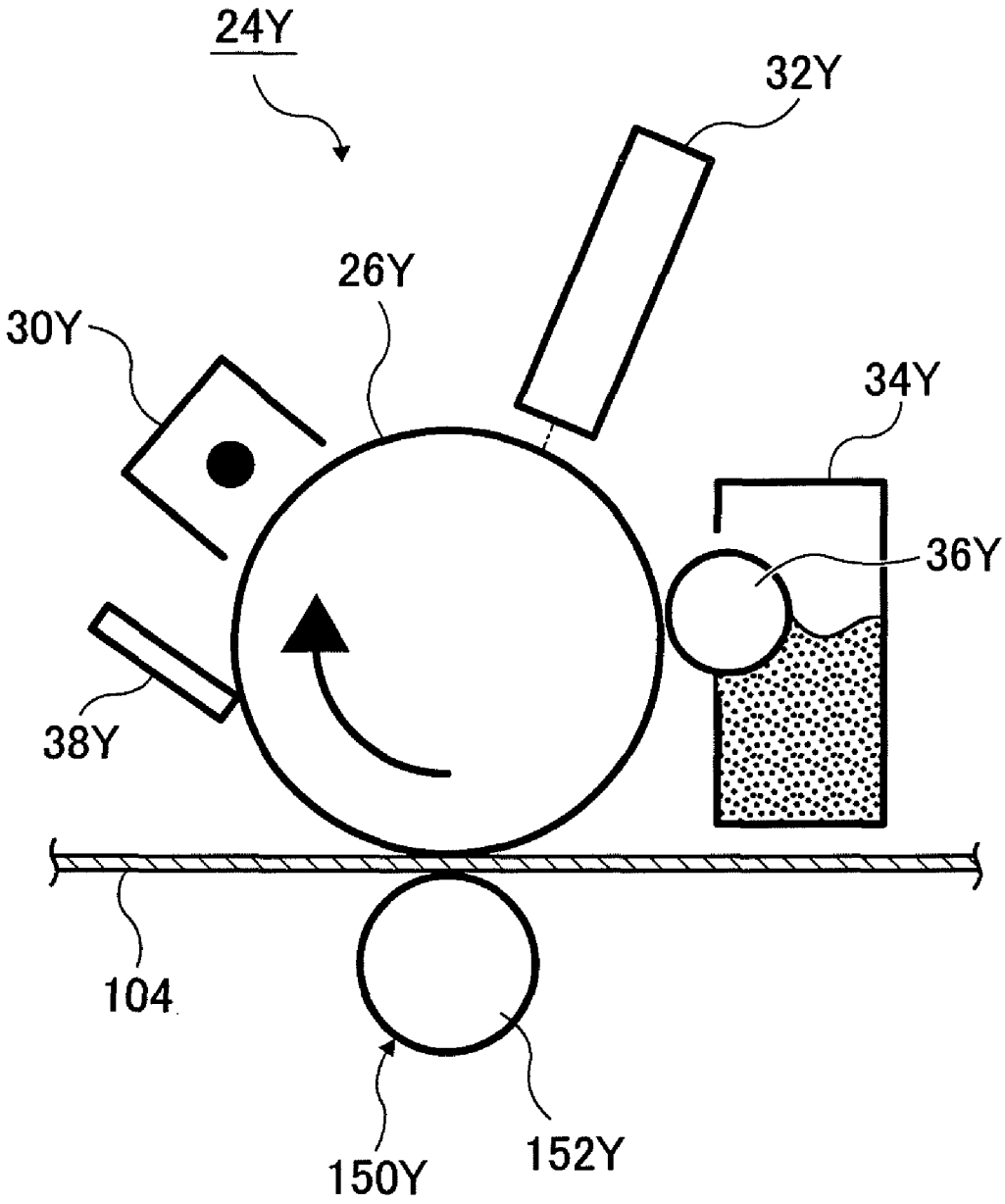
FIG. 2 is a sectional view, as seen from the front, of a part of an image forming section disposed in the image forming apparatus shown in FIG. 1.

FIG. 2 shows the yellow developer image forming section 24Y. The magenta developer image forming section 24M, the cyan developer image forming section 24C, and the black developer image forming section 24K are different in color, but have same components as the yellow developer image forming section 24Y described below. Therefore, the description of the magenta developer image forming section 24M, the cyan developer image forming section 24C, and the black developer image forming section 24K will be omitted.

As shown in FIG. 2, the yellow developer image forming section 24Y has the photoreceptor drum 26Y, the charging device 30Y, the latent image forming device 32Y, the developing device 34Y, and a cleaner 38Y. The charging device 30Y has e.g. a corona discharge device for uniformly charging the surface of the photoreceptor drum 26Y. For instance a laser exposure device serves as the latent image forming device 32Y. The latent image forming device 32Y forms a latent image on the surface of the photoreceptor drum 26Y by emitting light onto the surface of the photoreceptor drum 26Y uniformly charged with the charging device 30Y. As substitute for the corona discharge device, the charging device having a charging roller may be employed as the charging device 30Y. Further, as substitute for the laser exposure device, a light emitting device (LED) array may be employed as the latent image forming device 32Y.

The developing device 34Y has a development roller 36Y serving as a developer carrier. The development roller 36Y supplies the yellow developer to the photoreceptor drum 26Y, and thereby the latent image formed on the surface of the photoreceptor drum 26Y is developed with the yellow developer. The cleaner 38Y has e.g. a scraping member. After the yellow developer image is transferred onto the intermediate transfer member 104 by the first transfer roller 152Y, the scraping member scrapes the yellow developer remaining the surface of the photoreceptor drum 26Y.

Figure 3:
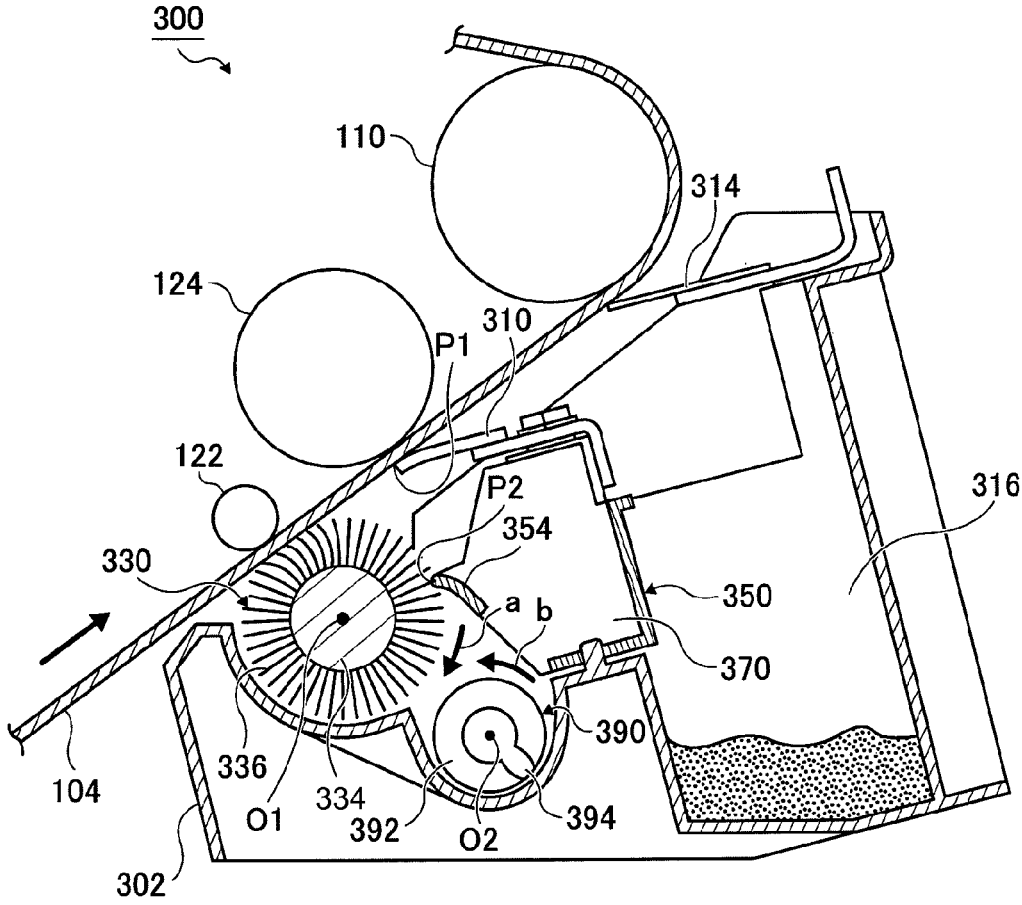
FIG. 3 is a sectional view, as seen from the front, of a cleaning device disposed in the image forming apparatus shown in FIG. 1.
Figure 4:
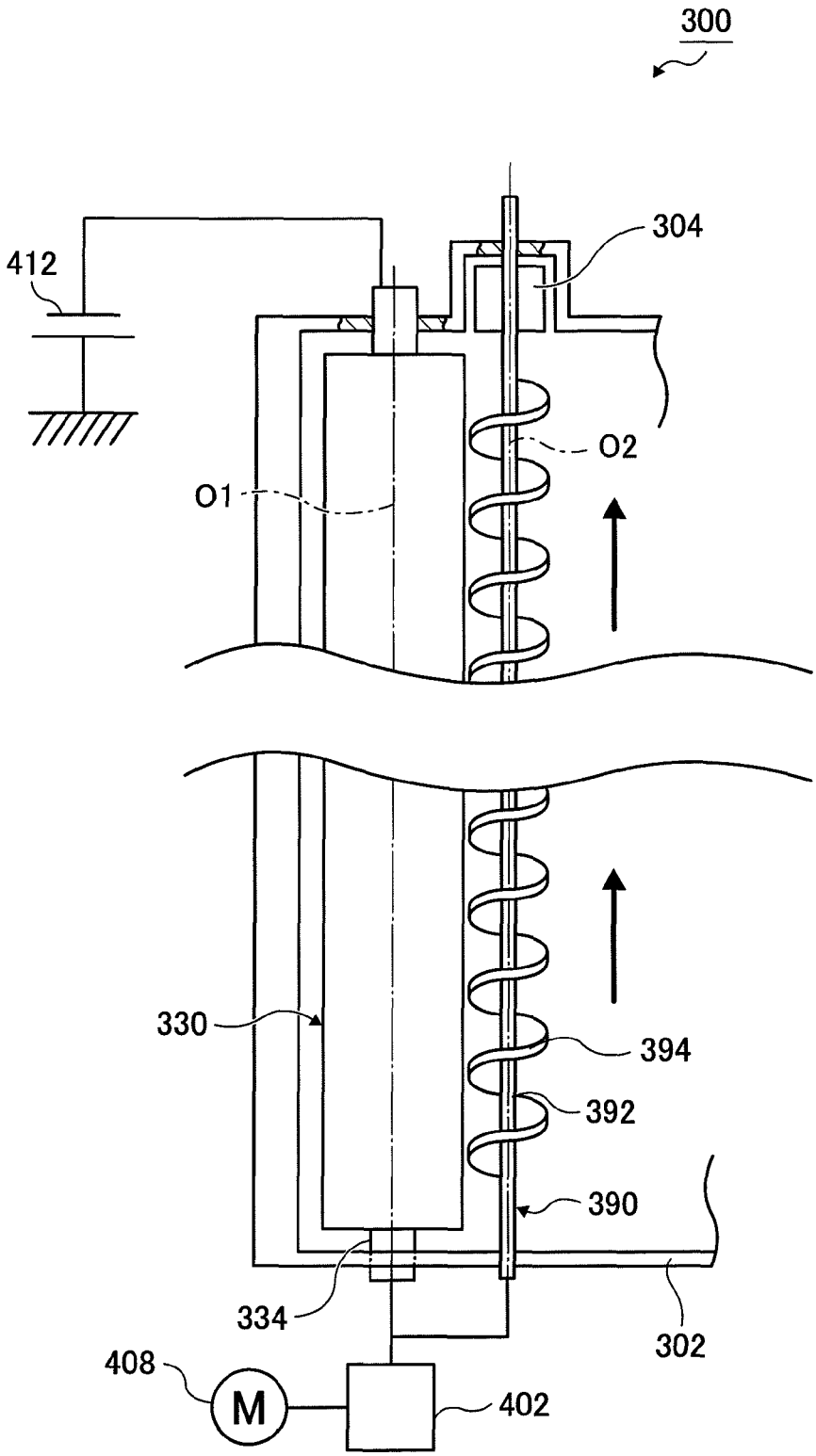
FIG. 4 is a plan view schematically illustrating a part of the cleaning device of FIG. 3 without a flicking member.

FIG. 3 and FIG. 4 illustrate the cleaning device 300.

As shown in FIG. 3, the cleaning device 300 has a cleaning device main body 302 in which a cleaning blade 310, a scraper 314, a brush 330, a flicking member 350, and a transport device 390 are mounted. Further in the cleaning device main body 302, a waste developer collecting section 316 is formed. Furthermore in the cleaning device main body 302, a discharge opening 304 for discharging a developer outside the cleaning device main body 302 is defined.

The cleaning blade 310 serves as a scraping member that touches the intermediate transfer member 104 and scrapes a developer on the surface of the intermediate transfer member 104. The cleaning blade 310 is made of a flexible material such as a rubber and a resin. In the cleaning blade 310, one end is fastened to the cleaning device main body 302, and the other end abuts the intermediate transfer member 104 at the contact position P1. The position where the cleaning blade 310 abuts the intermediate transfer member 104 will be described below as the contact position P1.

The scraper 314 is arranged downstream of the cleaning blade 310 in the movement direction of the intermediate transfer member 104, and scrapes a small amount of the developer remaining on the surface of the intermediate transfer member 104 after scraping of the cleaning blade 310. The scraped developer from the intermediate transfer member 104 by the scraper 314 is dropped down and is collected into the waste developer collecting section 316.

The brush 330 touches the surface of the intermediate transfer member 104 while rotating. The brush 330 is further cylindrically and has a core material 334 made from a conductive material. Both ends of the core material 334 are supported with the cleaning device main body 302 so that the brush 330 rotates on an axis O1. As shown in FIG. 4, for instance a drive source 408 such as a motor is connected to a front side of the core material 334 (the front side face in FIG. 3, or the bottom side face in FIG. 4) via a drive transmission mechanism 402. Further a power source 412 serving as a bias applying device for applying a bias to the brush 330 is provided in the core material 334.

The brush 330 further has numerous bristles 336. The bristles 336 are set on the surface of the core material 334 by e.g. implantation so as to radially extend from the center, the axis O1. The bristles 336 are made of a conductive material such as nylon, acryl, and polyester, and have for instance 1 to 4 denier in diameter. The term "denier" refers to the weight in grams for a 9000 meter fiber, and is used to alternatively represent the unmeasurable diameter of e.g. a fiber in a weight of a certain length. When a bristle having 2 denier is used, the density of the bristles 336 on the surface of the brush 330 is e.g. about 20 to about 40 of thousands per square centimeter.

Positioned vertically below the contact position P1, the bristles 336 receive the developer which are scraped at the contact position P1 from the intermediate transfer member 104 and is falling.

Further, receiving drive from the drive source 408, the brush 330 rotates in the arrow a direction shown in FIG. 3. Thus, the brush 330 has a function of removing the developer adhering to the surface of the intermediate transfer member 104. The circumferential velocity of the brush 330 is set to e.g. about two to three times faster than the circumferential velocity of the intermediate transfer member 104.

Since the brush 330 is subjected to a voltage while contacting the intermediate transfer member 104, the brush 330 has a charging function to charge the intermediate transfer member 104. If the volume resistance of the intermediate transfer member 104 is more than the predetermined value in the image forming apparatus 10, in the intermediate transfer member 104, the electric charge remains at a position subjected to an electric charge by the second transfer device 170 even after the position reaches a position of the first transfer device 150Y (refer to FIG. 1). Therefore, the residual charge may affect the subsequent image formation to the deterioration of image quality. In the image forming apparatus 10 of the exemplary embodiment according to the present invention, the intermediate transfer member 104 is charged by the brush 330 after passing through the second transfer device 170 and before reaching the first transfer device 150Y, and thereby the residual charge in the intermediate transfer member 104 reduces.

The brush 330 has the core material 334 and the bristles 336 respectively made of a conductive material. Accordingly, the developer tends to adhere to the bristles 336 because of voltage applied by the power source 412, and thereby it is afraid that the adhering developer remains between the plural bristles 336. When the developer remains between the plural bristles 336, the electric resistance of the brush 330 increases because toner particles being an insulator fill in the space of the plural bristles 336. Accordingly, since the current flow is inhibited in the brush 330, it is afraid that the quality of the brush 330 reduces. The toner particles filling in the space of the bristles 336 further prevent the bristles 336 from deforming, and thereby the torque generated by the drive source 408 falls short, and the rotating of the brush 330 is inhibited.

The flicking member 350 serves as a removing member for removing the developer adhering to the brush 330, and has a contact section 354 being the first position contacting the bristles 336 and a support section 370 supporting the contact section 354. The flicking member 350 will be described in detail later. It will be defined a position where the developer is removed from the brush 330 by the flicking member 350 as a removal position P2. The removal position P2 is a position where the bristles 336 having numerous bristles and the flicking member 350 serving as the removing member touch each other.

The transport device 390 serves for transporting the developer removed from the brush 330 by the flicking member 350. The transport device 390 has a transport member 392 with blade 394 having a spiral shape. The transport member 392 is mounted in the cleaning device main body 302 so as to rotate on an axis O2. Thus, receiving drive from the drive source 408 via the drive transmission mechanism 402, the transport member 392 rotates toward the arrow b direction shown in FIG. 3. Because of the rotation toward the arrow b direction, the transport member 392 transports the developer from the front side face to the back side face in FIG. 4, i.e. to the discharge opening 304.

As the foregoing description, the drive transmitted from the drive source 408 via the drive transmitting mechanism 402 is applied to both of the transport member 392 and the brush 330. Accordingly, when the rotation of the brush 330 reduces because of the shortage of the torque from the drive source 408 caused by the remaining of the developer in the brush 330, the rotation of the transport member 392 reduces as well.

Figure 5:
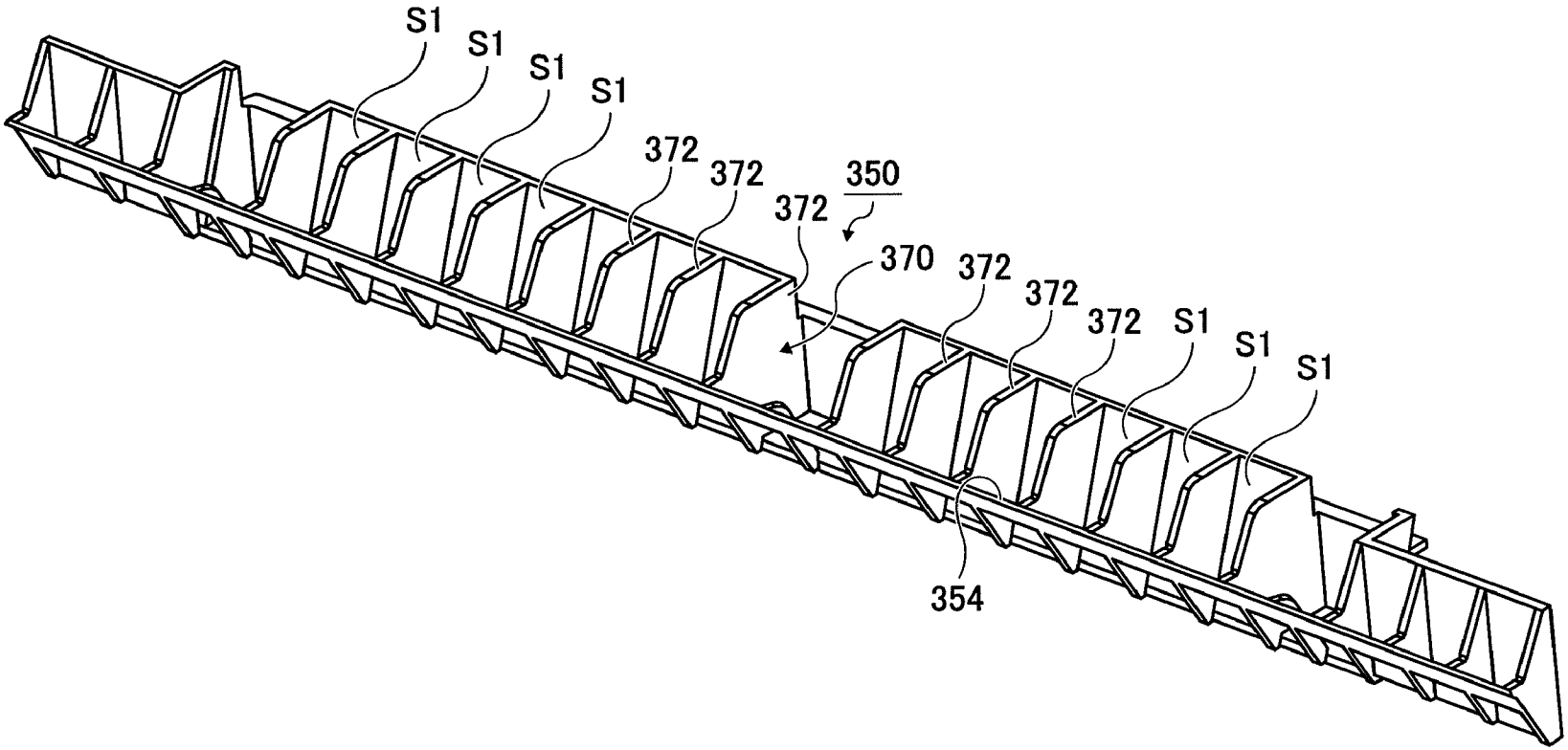
FIG. 5 is a perspective view illustrating the flicking member disposed in the cleaning device shown in FIG. 3.

FIG. 5 illustrates the flicking member 350.

As shown in FIG. 5, the flicking member 350 has the contact section 354 and the support section 370. The contact section 354 extends along the same direction as the longitudinal direction of the brush 330 (the direction along the axis O1). The support section 370 has e.g. plural platy members 372 vertically arranged, and the plural platy members 372 are arranged at intervals. Consequently, inter-spaces S1 are defined between the platy members 372 adjacent to each other and each the inter-space S1 passes through the flicking member 350 vertically. The inter-spaces S1 are formed between the contact section 354 where the numerous bristles 336 and the flicking member 350 firstly touch each other, and the transport device 390 so that the developer drops toward the transport device 390.

Figure 6:
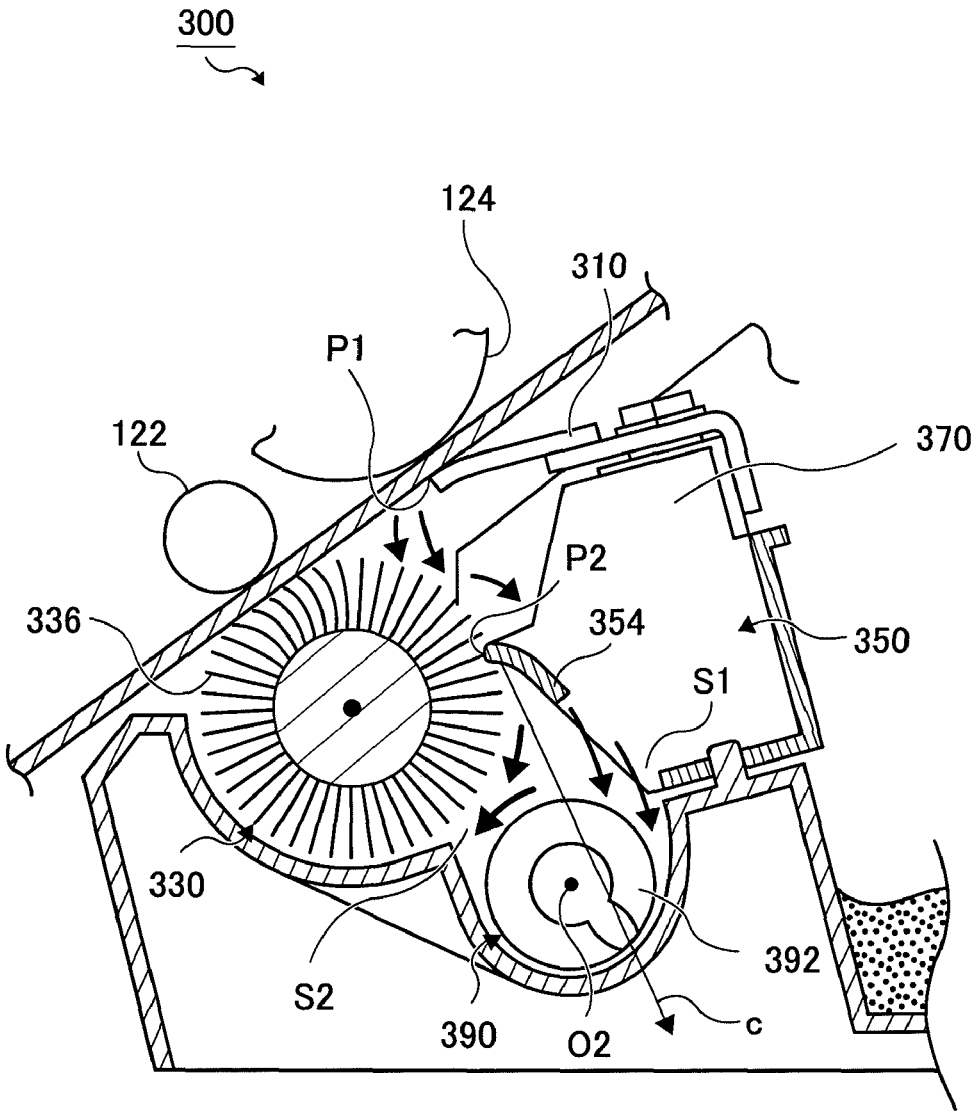
FIG. 6 is a view illustrating the movement of the developer in the cleaning device shown in FIG. 3.

FIG. 6 illustrates a view explaining the movement of the developer in the cleaning device 300.

As shown in FIG. 6, the flicking member 350 is disposed so as to contact the numerous bristles 336, and contacts the numerous bristles 336 and separates from the numerous bristles 336 because of the rotation of the brush 330. That is, the flicking member 350 removes the developer from the numerous bristles 336 by elastically deforming the numerous bristles 336 contacting the numerous bristles 336, and returning the numerous deformed bristles 336 back to normal getting away from the numerous bristles 336.

As also shown in FIG. 6, the removal position P2 is positioned lower than the contact position P1 in the gravitational direction. Therefore, the developer scraped with the cleaning blade 310 from the intermediate transfer member 104 at the contact position P1 moves toward the surface of the brush 330 while falling. Further, at least a part of the developer on the bristles 336 of the brush 330 is removed with the flicking member 350 from the brush 330 at the removal position P2.

As furthermore shown in FIG. 6, the transport device 390 is positioned lower than the removal position P2 in the gravitational direction. Therefore, the developer removed at the removal position P2 moves to the transport device 390, and is further transported by the transport device 390. Since the inter-spaces S1 in the image forming apparatus 10 are formed, a part of the developer removed from the brush 330 by contacting to the contact section 354 passes through the inter-spaces S1, and thereby moves to the transport device 390 while falling. Therefore, the developer removed from the brush 330 with the contact section 354 moves to the transport device 390 while passing through the inter-spaces S1, and thereby hardly remains around the contact section 354.

The inter-spaces S1 are defined so that, as shown in FIG. 6, at least a part of the developer removed from the brush 330 drops to the farther position than the axis O2 from the brush 330 in the horizontal direction of the transport member 392. Then, compared with another inter-space S1 defined for dropping the developer toward the brush 330 side rather than the axis O2 side in the horizontal direction of the transport member 392, the developer hardly remains in an inter-space S2 formed between the brush 330 and the transport device 390 because of the inter-spaces S1 according to the exemplary embodiment of the present invention.

Further as shown in FIG. 6, the inter-spaces S1 are defined so as to being at a position farther than the axis O2 from the brush 330 in the horizontal direction. Therefore, compared with the inter-spaces S1 at a position nearer than the axis O2 from the brush 330, the developer hardly remains in the inter-space S2.

In addition to the removal of the developer from the brush 330 in a manner that drops the developer through the inter-spaces S1 toward the transport device 390, the flicking member 350 removes the developer from the bristles 336 of the brush 330 by flicking. The flicking direction of the developer by the flicking member 350 at the removal position P2 is along a direction of the tangential line c of the brush 330 at the removal position P2. In the exemplary embodiment of the present invention, the flicking member 350 is arranged so that the tangential line c passes through the farther side than the axis O2 of the transport member 392 away from the brush 330. The flicked developer by the flicking member 350 is flicked toward the side away from the brush 330 rather than the axis O2 in the horizontal direction.

Therefore, compared with the case where the flicking member 350 is arranged so that the tangential line c extends toward a closer side to the brush 330 than the axis O2 of the transport member 392 and thereby the developer is flicked toward the closer side to the brush 330 than the axis O2 in the horizontal direction, the flicked developer by the flicking member 350 according to the exemplary embodiment of the present invention hardly remain into the inter-space S2.

As shown in FIG. 6, the brush 330, the flicking member 350, and the transport member 392 are arranged so that a tangential line of the brush 330 at the contact point (P2) where the numerous bristles 336 and the flicking member 350 touch each other is at the opposite side of the rotating axis of the brush 330 with respect to the parallel line which is parallel to the tangential line and passes through the axis of the transport member 392.

Figure 7:
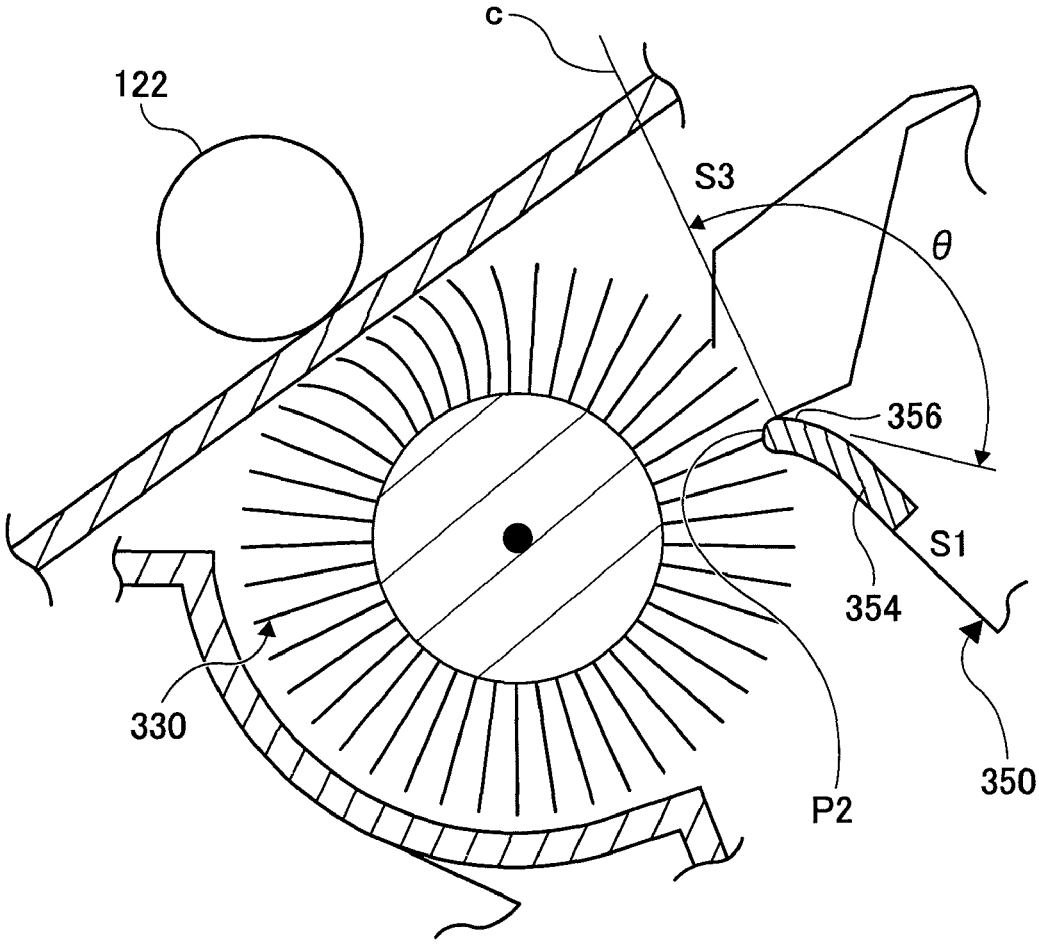
FIG. 7 is a partial enlarged view of the flicking member disposed in the cleaning device shown in FIG. 3.

FIG. 7 illustrates the enlarged view of the flicking member 350.

As shown in FIG. 7, the flicking member 350 has a guide face 356 for guiding at least a part of the removed developer from the brush 330 toward the inter-spaces S1. The guide face 356 is positioned so that an angle θ between the guide face 356 and the upstream face of the tangential line c of the brush 330 at the removal position P2 in the rotating direction of the brush 330 is obtuse, that is, the angle θ is greater than 90 degrees. Therefore, the developer hardly remains the inter-spaces S3 close to the removal position P2 compared to the case where the angle θ is less than 90 degrees.

Figure 8:
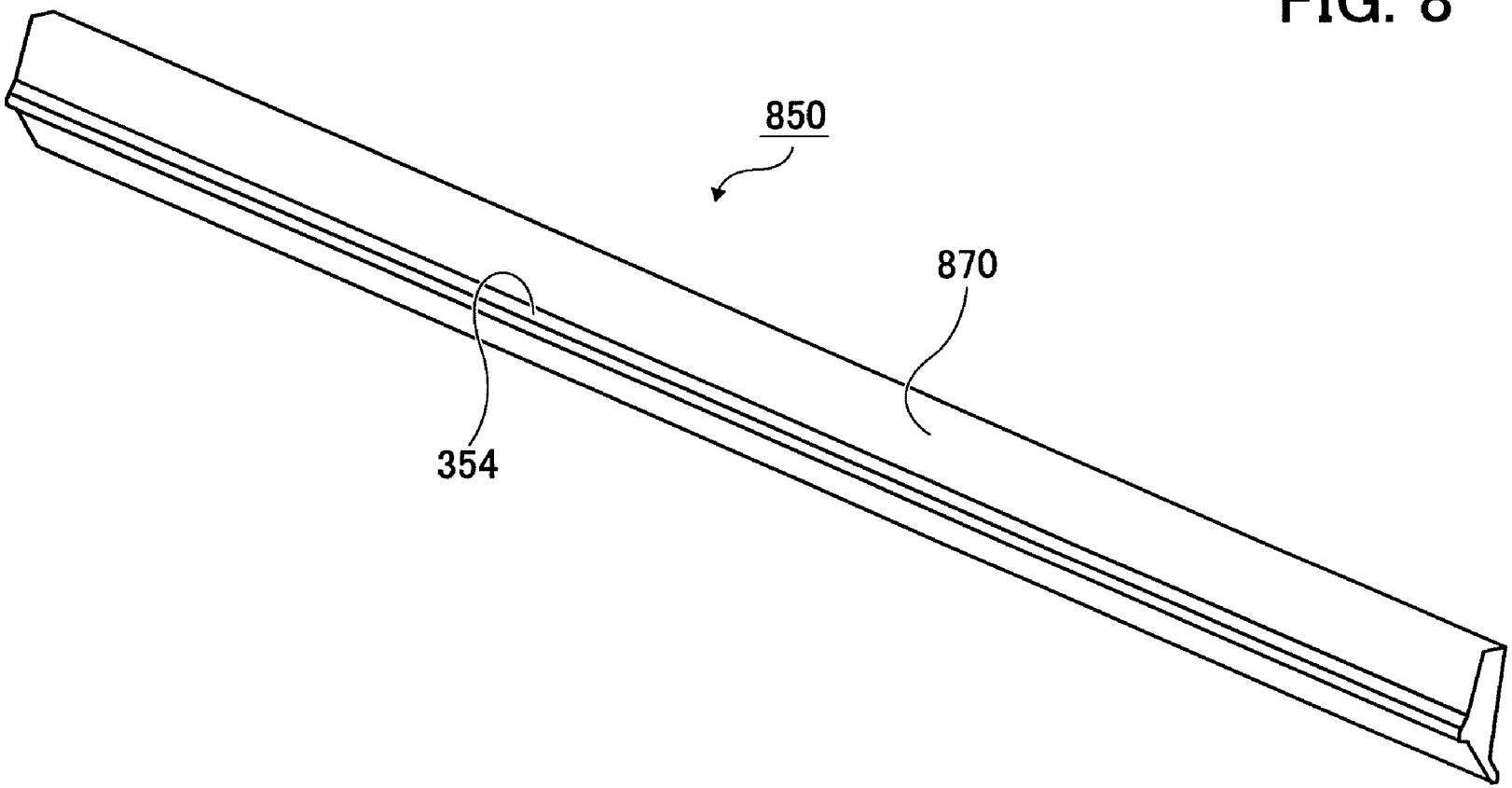
FIG. 8 is a perspective view illustrating a flicking member disposed in an image forming apparatus according to a comparative example of the exemplary embodiment of the present invention.

FIG. 8 illustrates the flicking member 850 in an image forming apparatus according to the comparative example. The image forming apparatus 10 according to the exemplary embodiment of the present invention has the flicking member 350 in which the support section 370 supports the contact section 354 so as to define the inter-spaces S1. By contrast, the flicking member 850 according to the comparative example has a support section 870 with no inter-space S1. Therefore, the developer removed from the brush 330 remains around the contact section 354 in the flicking member 350 according to the comparative example.

As described above, the present invention may be applied to an image forming apparatus such as a duplicator, a facsimile apparatus, and a printer, and is further applied to a cleaning device and a charging device served in these image forming apparatuses.

The foregoing description of the exemplary embodiment of the present invention has been provided for the purposes of illustration and description. It is not intended to be exhaustive or to limit the invention to the precise forms disclosed. Obviously, many modification and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suites to the particular use contemplated. It is intended that the scope of the invention be defined by the following claims and their equivalents.

What is claimed is:

1. A cleaning device comprising:

a brush that has numerous bristles rotating and contacting to a surface of an image carrier;

a removing member that is disposed so as to contact to the numerous bristles and removes a developer adhering to the numerous bristles by elastically deforming the numerous bristles and further returning the numerous deformed bristles back to normal; and a transport member that is disposed lower than the removing member in a gravitational direction and transports the developer removed with the removing member by rotating on an axis, wherein at least a part of the developer removed from the numerous bristles falls to a farther position than the axis of the transport member from the brush in a horizontal direction, and wherein the removing member is arranged so that a tangential line of the brush at a position where the developer is flicked passes through the farther side than the axis of the transport member from the brush.

2. The cleaning device according to claim 1, wherein the removing member removes at least a part of the developer adhering to the numerous bristles from the numerous bristles by flicking, and is arranged so as to flick the developer from the numerous bristles toward the farther side than the axis of the transport member from the brush in the horizontal direction.

3. The cleaning device according to claim 1, wherein the removing member removes at least a part of the developer adhering to the numerous bristles from the numerous bristles by flicking.

4. The cleaning device according to claim 1, wherein the removing member has a guide face that guides at least a part of the developer removed from the numerous bristles, and the guide face is arranged so that an angle between the guide face and an upstream side of a tangential line of the brush at a contact point where the numerous bristles and the removing member touch each other in the rotation direction of the brush is obtuse.

5. The cleaning device according to claim 1, wherein the brush charges the image carrier due to application of a voltage while contacting the image carrier.

6. The cleaning device according to claim 1, wherein the removing member comprises a contact section that contacts the numerous bristles, and a support section comprising a plurality of platy members arranged at intervals to form a plurality of inter-spaces between adjacent platy members, and the developer removed by the contact section passes through the inter-spaces.

7. A cleaning device comprising:

a brush that has numerous bristles rotating and contacting to a surface of an image carrier;

a removing member that is disposed so as to contact to the numerous bristles and removes a developer adhering to the numerous bristles by elastically deforming the numerous bristles and further returning the numerous deformed bristles back to normal; and a transport member that is disposed lower than the removing member in a gravitational direction and transports the developer removed with the removing member by rotating on an axis, wherein the brush, the removing member, and the transport member are arranged so that a tangential line of the brush at a contact point where the numerous bristles and the removing member touch each other is at an opposite side of a rotating axis of the brush with respect to a parallel line which is parallel to the tangential line and passes through the axis of the transport member.

8. The cleaning device according to claim 7, wherein the removing member comprises a contact section that contacts the numerous bristles, and a support section comprising a plurality of platy members arranged at intervals to form a plurality of inter-spaces between adjacent platy members, and the developer removed by the contact section passes through the inter-spaces.

9. An image forming apparatus comprising:

an image forming section that forms an image with a developer;

an image carrier that holds the image formed by the image forming section; and a cleaning device that cleans the image carrier, wherein the cleaning device comprising:

a brush that has numerous bristles rotating and contacting to a surface of an image carrier;

a removing member that is disposed so as to contact to the numerous bristles and removes a developer adhering to the numerous bristles by elastically deforming the numerous bristles and further returning the numerous deformed bristles back to normal; and a transport member that is disposed lower than the removing member in a gravitational direction and transports the developer removed with the removing member by rotating on an axis, wherein at least a part of the developer removed from the numerous bristles falls to a farther position than the axis of the transport member from the brush in a horizontal direction, and wherein the removing member is arranged so that a tangential line of the brush at a position where the developer is flicked passes through the farther side than the axis of the transport member from the brush.

10. The image forming apparatus according to claim 9, wherein the removing member comprises a contact section that contacts the numerous bristles, and a support section comprising a plurality of platy members arranged at intervals to form a plurality of inter-spaces between adjacent platy members, and the developer removed by the contact section passes through the inter-spaces.

11. An image forming apparatus comprising:

an image forming section that forms an image with a developer;

an image carrier that holds the image formed by the image forming section; and a cleaning device that cleans the image carrier, wherein the cleaning device has:

a brush that has numerous bristles rotating and contacting to a surface of an image carrier;

a removing member that is disposed so as to contact to the numerous bristles and removes a developer adhering to the numerous bristles by elastically deforming the numerous bristles and further returning the numerous deformed bristles back to normal; and a transport member that is disposed lower than the removing member in a gravitational direction and transports the developer removed with the removing member by rotating on an axis, wherein the brush, the removing member, and the transport member are arranged so that a tangential line of the brush at a contact point where the numerous bristles and the removing member touch each other is at a opposite side of a rotating axis of the brush with respect to a parallel line which is parallel to the tangential line and passes through the axis of the transport member.

12. The cleaning device according to claim 11, wherein the brush charges the image carrier due to application of a voltage while contacting the image carrier.

13. The image forming apparatus according to claim 11, wherein the removing member comprises a contact section that contacts the numerous bristles, and a support section comprising a plurality of platy members arranged at intervals to form a plurality of inter-spaces between adjacent platy members, and the developer removed by the contact section passes through the inter-spaces.

14. A cleaning device comprising:

a brush comprising a plurality of bristles that rotate and receive developer removed from a surface of an image carrier;

a transport device comprising a transport shaft, and a blade;

a removing member comprising a contact section that contacts the bristles at a contact point, and a support section comprising a plurality of plates arranged at intervals to form a plurality of inter-spaces between the contact section and the transport device.

15. The cleaning device according to claim 14, wherein the brush rotates about a first axis, and the transport shaft rotates about a second axis, and the brush, the removing member, and the transport device are positioned such that the first axis, the contact point, and the second axis are arranged in order along a reference direction.

16. The cleaning device according to claim 14, wherein the removing member is arranged so that a tangential line of the brush at the contact point passes through a farther side than an axis of the transport shaft from the brush.

* * * * *